US007579957B2

(12) United States Patent
Igami et al.

(10) Patent No.: US 7,579,957 B2
(45) Date of Patent: Aug. 25, 2009

(54) METHOD AND APPARATUS FOR ACHIEVING BI-AXIAL TILT MONITORING USING A SINGLE-AXIS TILT MONITORING DEVICE

(75) Inventors: Hideo Igami, Fujisawa (JP); Yuhta Ishii, Machida (JP); Robert Tucker Sanders, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 371 days.

(21) Appl. No.: 11/552,163

(22) Filed: Oct. 24, 2006

(65) Prior Publication Data

US 2008/0094241 A1 Apr. 24, 2008

(51) Int. Cl.
*G08B 21/00* (2006.01)

(52) U.S. Cl. ..... 340/689; 340/669; 324/202; 324/262

(58) Field of Classification Search ..... 340/689, 340/669; 33/512, 356, 366.21; 324/202, 324/247, 260, 262; 702/121, 92; 73/510
See application file for complete search history.

(56) References Cited

U.S. PATENT DOCUMENTS 4,549,277 A 10/1985 Brunson et al.
6,543,147 B2 4/2003 Akieda
2003/0173877 A1* 9/2003 Pleiman et al. ..... 312/238
2003/0213136 A1 11/2003 Klock
2005/0080566 A1 4/2005 Vock et al.
2006/0100820 A1 5/2006 Davidson
2008/0094241 A1* 4/2008 Igami et al. ..... 340/689

FOREIGN PATENT DOCUMENTS

WO 2004020943 A1 3/2004

* cited by examiner

*Primary Examiner*—Davetta W Goins
*Assistant Examiner*—Hoi C Lau
(74) *Attorney, Agent, or Firm*—Yee & Associates, P.C.; Steven L. Bennett

(57) ABSTRACT

Bi-axial tilt monitoring apparatus and method for bi-axial tilt monitoring of an article using a single-axis tilt monitoring device. A bi-axial tilt monitoring apparatus according to exemplary embodiments includes a single-axis tilt monitoring device and a support member supporting the single-axis tilt monitoring device and mountable to an article to be monitored. The support member has a supporting surface for supporting the single-axis tilt monitoring device at an acute angle relative to a substantially vertical surface of the article to be monitored when the tilt monitoring apparatus is mounted to the article to be monitored.

9 Claims, 7 Drawing Sheets

METHOD AND APPARATUS FOR ACHIEVING BI-AXIAL TILT MONITORING USING A SINGLE-AXIS TILT MONITORING DEVICE

BACKGROUND OF THE INVENTION

1. Field of the Invention

The present invention relates generally to the tilt monitoring field and, more particularly, to a method and apparatus for bi-axial tilt monitoring using a single-axis tilt monitoring device.

2. Description of the Related Art

Many products are susceptible to being damaged by excessive tipping, and are particularly vulnerable to excessive tipping during shipping. For example, in the data processing field, products such as large servers, storage systems, tape libraries and enterprise printers cannot survive being tipped onto their sides or top, and if any of these products do tip over, the financial loss due to the resulting damage is often significant.

Because of the risk of financial loss due to tipping over, it is known to mount a tilt monitoring device to such products during shipping in order to monitor the products. The tilt monitoring device can include a date/clock function so that it can be determined not only if a damaging tipping has occurred, but when the tipping occurred so that the responsible party can more easily be identified for damage claim purposes and root cause analysis.

A known tilt monitoring device is the "Tilt Monitor Card" available from Kuroda Electric Co. Ltd., often referred to as a "TMC". The TMC utilizes a small, electrically conductive disk that slides out of position when the device is tilted more than 70 degrees from vertical and alters an electrical circuit in the device. Altering the circuit causes a digital clock in the device to freeze so as to indicate the precise time at which the excessive tilt event occurred.

The TMC tilt monitoring device is used by mounting it to a vertical surface of an article to be monitored, for example, on a product itself or on packaging containing the product. This is typically done prior to shipping of the article, and indicates whether the article was excessively tipped at any time during shipping.

The TMC tilt monitoring device, however, is a single-axis tilt monitoring device that is only able to detect tipping of an article around a single axis. In order to effectively monitor tipping at all angles, however, an article should be monitored for tipping around two axes. This problem is typically addressed by mounting two TMCs to two adjacent vertical surfaces of the article which are perpendicular to one another. For instance, one TMC placed on the left or right side of the article will monitor tipping onto its front or back side, and a second TMC, placed on the front or back side of the article will monitor tipping onto its right or left side. This solution, however, doubles the cost of monitoring an article, and can result in very significant additional expense when a large number of articles are shipped.

A bi-axial tilt monitoring device that monitors tilt around two axes is known that uses small beads to detect tilt. However, this known device does not include a date/clock function to indicate when an excessive tipping of a product occurred.

There is, accordingly, a need for a low cost bi-axial tilt monitoring apparatus that effectively detects tipping of an article in all directions, and that also includes a date/clock function to precisely indicate the time when an excessive tipping event occurs.

BRIEF SUMMARY OF THE INVENTION

Exemplary embodiments provide a bi-axial tilt monitoring apparatus and a method for bi-axial tilt monitoring of an article using a single-axis tilt monitoring device. A bi-axial tilt monitoring apparatus according to exemplary embodiments includes a single-axis tilt monitoring device, and a support member supporting the single-axis tilt monitoring device and mountable to an article to be monitored. The support member has a supporting surface for supporting the single-axis tilt monitoring device at an acute angle relative to a substantially vertical surface of the article to be monitored when the tilt monitoring apparatus is mounted to the article to be monitored.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
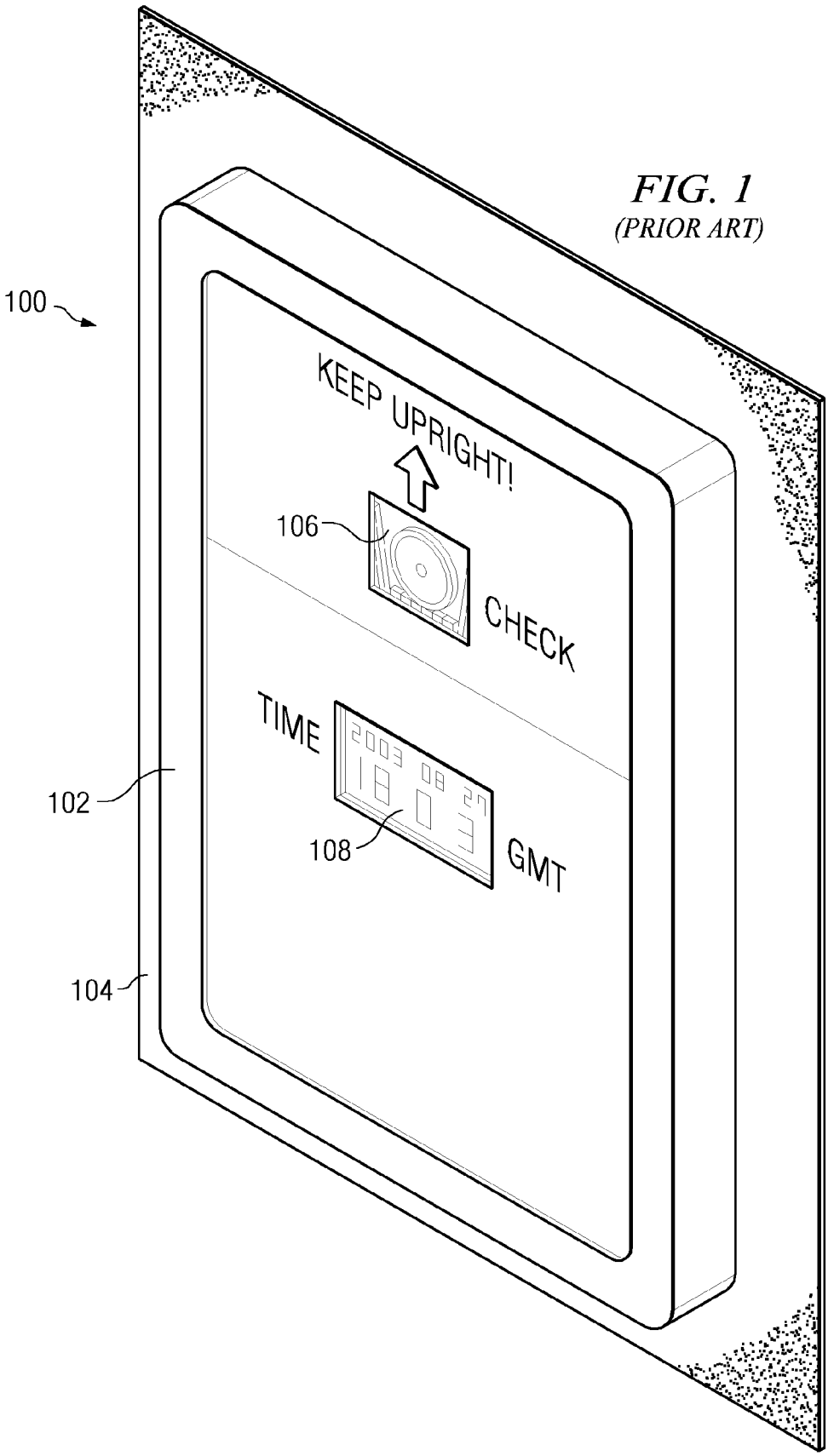
FIG. 1 (PRIOR ART)
FIG. 1 illustrates a known single-axis tilt monitoring device to assist in explaining exemplary embodiments.

FIG. 1 illustrates a known single-axis tilt monitoring device to assist in explaining exemplary embodiments. The device comprises a tilt monitoring device available from Kuroda Electric Co. Ltd. designated as the "Tilt Monitor Card" or the "TMC". The device is generally designated by reference number 100 and comprises a molded, generally flat, rectangular-shaped housing portion 102 and a mounting flange 104 for mounting the device to an article to be monitored (not shown in FIG. 1). Housing 102 incorporates a single-axis tilt monitoring mechanism (also not shown in FIG. 1).

Tilt monitoring device 100 includes a small opening 106 which functions as a tilt indicator to indicate whether device 100 and, hence, an article to which device 100 is mounted, has excessively tipped, and a clock 108 to indicate precisely when an excessive tipping event occurred.

Figure 2:
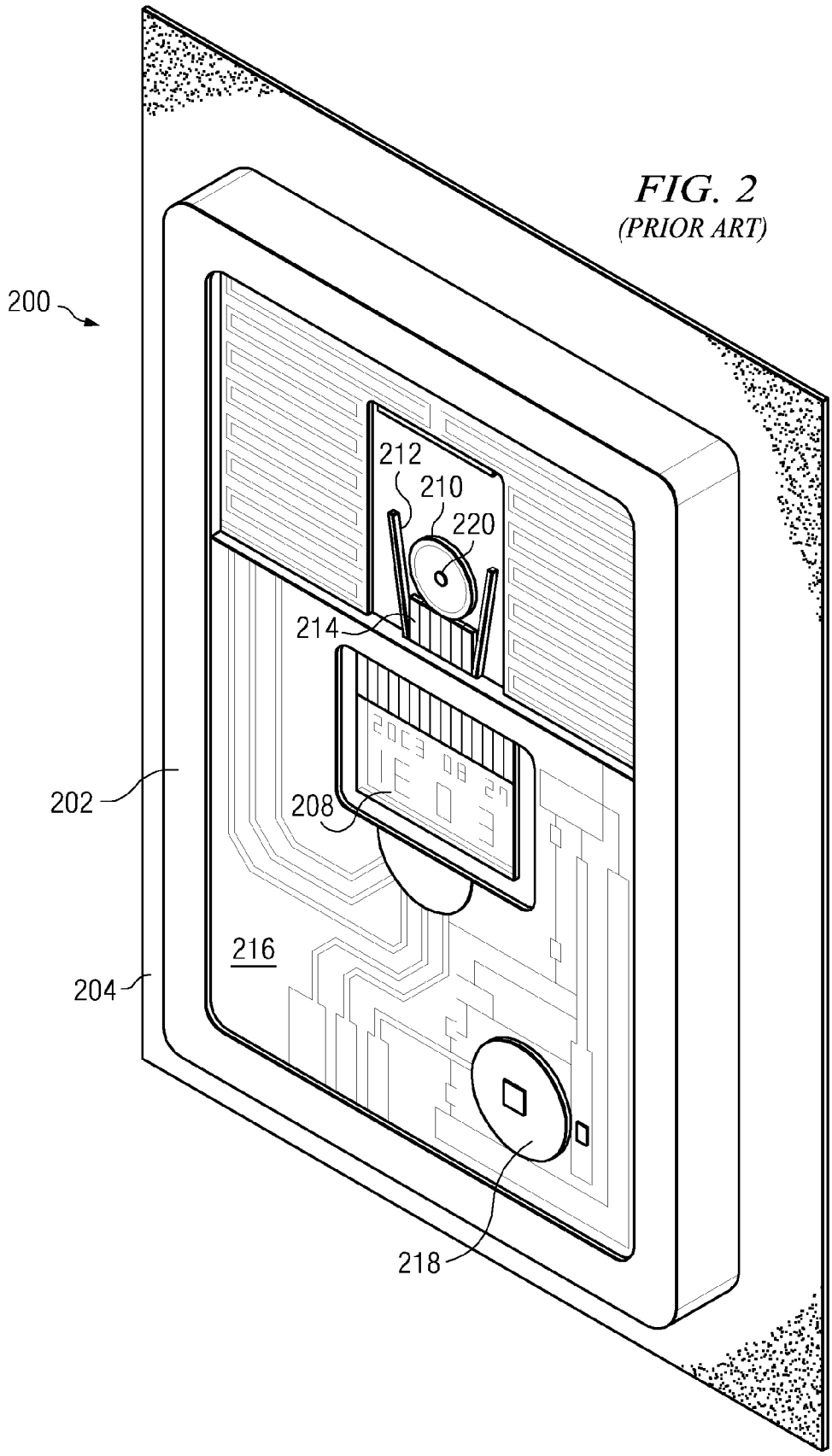
FIG. 2 (PRIOR ART)
FIG. 2 is an internal view of the tilt monitoring device of FIG. 1 to illustrate operation of the device.

FIG. 2 is an internal view of the tilt monitoring device of FIG. 1 to illustrate operation of the device. The tilt monitoring device is generally designated by reference number 200 in FIG. 2, and corresponding reference numbers are used to refer to corresponding components of the device. As shown, the device includes a small, electrically conductive disk 210 which is normally supported within a tapered support structure 212. So long as device 200 is maintained in a generally upright position, disk 210 will remain in support structure 212 and remain in contact with circuit portion 214 of electrical circuit 216 within housing 202. Clock 208, also within housing 202, is incorporated within circuit 216 and accurately keeps both time (based on Greenwich Mean Time) and date. A button cell battery 218 powers electrical circuit 216, and an arming pin (not shown in FIG. 2) is also provided to activate the device when it is to be used. Specifically, prior to arming device 200, conductive disk 210 is supported in a slightly elevated position out of contact with circuit portion 214 of electrical circuit 216 by an arming pin that extends through hole 220 in the center of the disk. So long as conductive disk 210 is out of electrical contact with circuit portion 214, the circuit remains open and inactive. When, however, the arming pin is removed, conductive disk 210 drops down into support structure 212 and into contact with circuit portion 214 to arm device 200.

After being armed, if device 200 is tipped over by an excessive amount, for example, by more than 70 degrees, conductive disk 210 will slide out of support structure 212 and move out of contact with circuit portion 214. This will alter electrical circuit 216 and cause clock 208 to immediately freeze at its current time and date and, thus, precisely indicate when the tipping occurred. In this regard, TMC 200 is designed to detect and indicate an excessive tipping event of over 70 degrees which is desirable when monitoring products in the data processing field such as large servers, storage systems, tape libraries and enterprise printers. It should be understood, however, that exemplary embodiments are not limited to detecting and indicating an excessive tipping event of any particular angle, as other products may become damaged at tilt angles greater or less than 70 degrees.

After the excessive tipping event, clock 208 will show ARMED time/date and TIPPED time/date alternately. In this regard, the configuration of support structure 212 is such that once disk 210 slides out of structure 212, it will be unable to slide back into the structure and into contact with circuit portion 214 such that circuit 216 will remain in a permanently altered state following the excessive tipping event.

Disk 210 is of a first color (metallic silver), and when supported in support structure 212, is visible through opening 106 in FIG. 1 to indicate that device 100 is armed but has not been excessively tipped. When disk 210 slides out of support structure 212, however, a marking of a different color (red) is exposed and becomes visible through opening 106 to indicate that device 100 has been excessively tipped.

Figure 3:
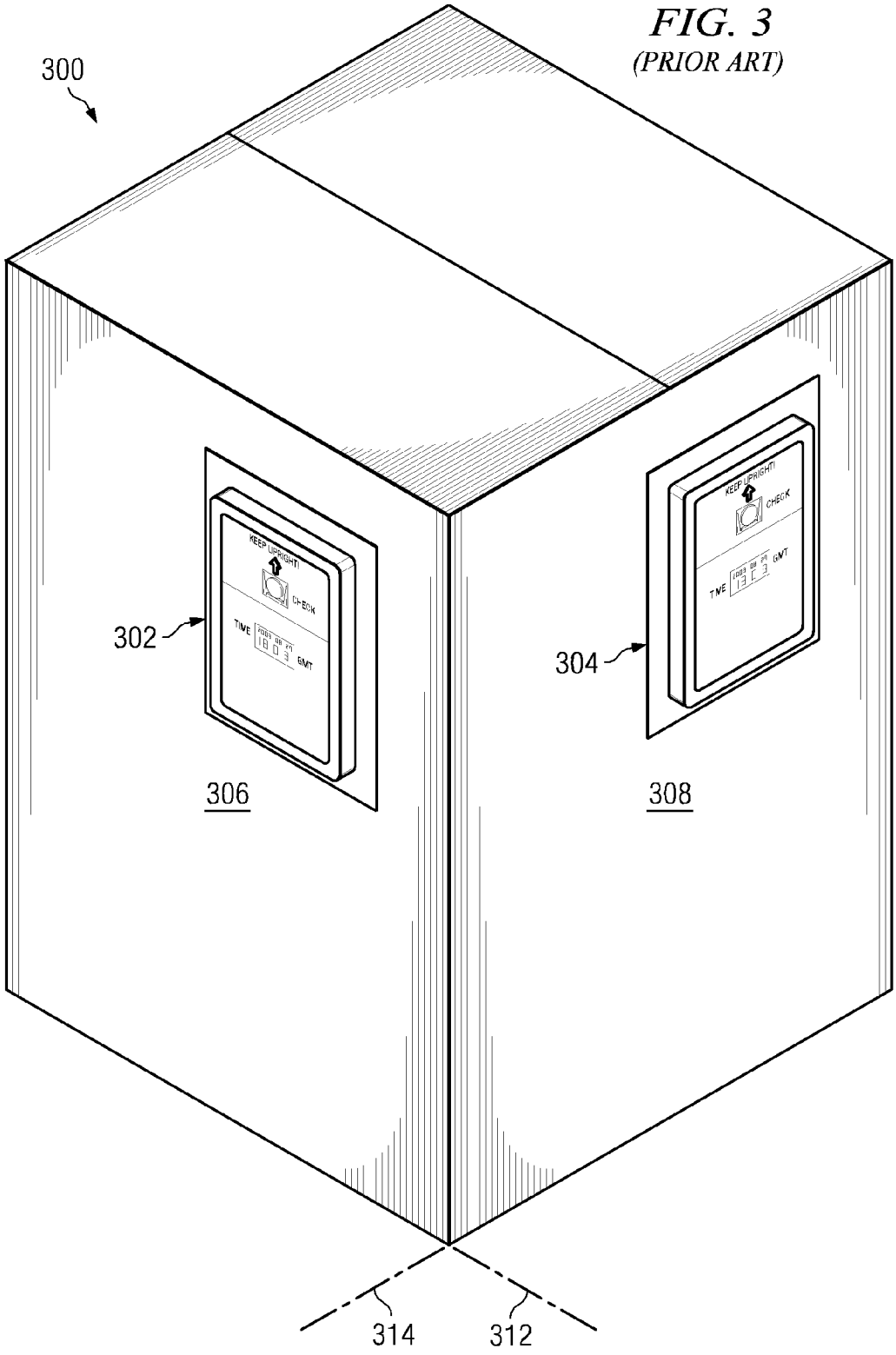
FIG. 3 (PRIOR ART)
FIG. 3 schematically illustrates a known method for mounting single-axis tilt monitoring devices to an article to provide bi-axial tilt monitoring of the article.

FIG. 3 schematically illustrates a known method for mounting single-axis tilt monitoring devices to an article to provide bi-axial tilt monitoring of the article. The article is generally designated by reference number 300, and in the illustrated example, comprises a rectangular box containing a product to be monitored. As shown in FIG. 3, two single-axis tilt monitoring devices 302 and 304 are mounted to vertical sides 306 and 308, respectively, of article 300. Single-axis tilt monitoring devices 302 and 304 may each be implemented as tilt monitoring device 100 in FIG. 1 or tilt monitoring device 200 in FIG. 2.

Each tilt monitoring device 302 and 304 is only effective in monitoring tipping of article 300 around one axis and, thus, would not be effective by itself to monitor tipping of article 300 in all directions. Accordingly, it is necessary to mount two devices to any two adjacent vertical sides, e.g., sides 306 and 308, of rectangular article 300 in order to monitor tipping of article 300 in all directions. Specifically, tilt monitoring device 302 monitors tilting of article 300 around axis 312, and tilt monitoring device 304 monitors tilting of article 300 around axis 314. If surfaces 306 and 308 are substantially perpendicular to one another, axes 312 and 314 will also be substantially perpendicular to one another such that devices 302 and 304 together are effective in monitoring tipping of article 300 in all directions.

Although mounting two single-axis tilt monitoring devices to an article as shown in FIG. 3 is effective in detecting tipping of the article, this solution requires the use of two tilt monitoring devices for each article to be monitored which can result in very significant expense when a large number of articles are shipped.

Figure 4:
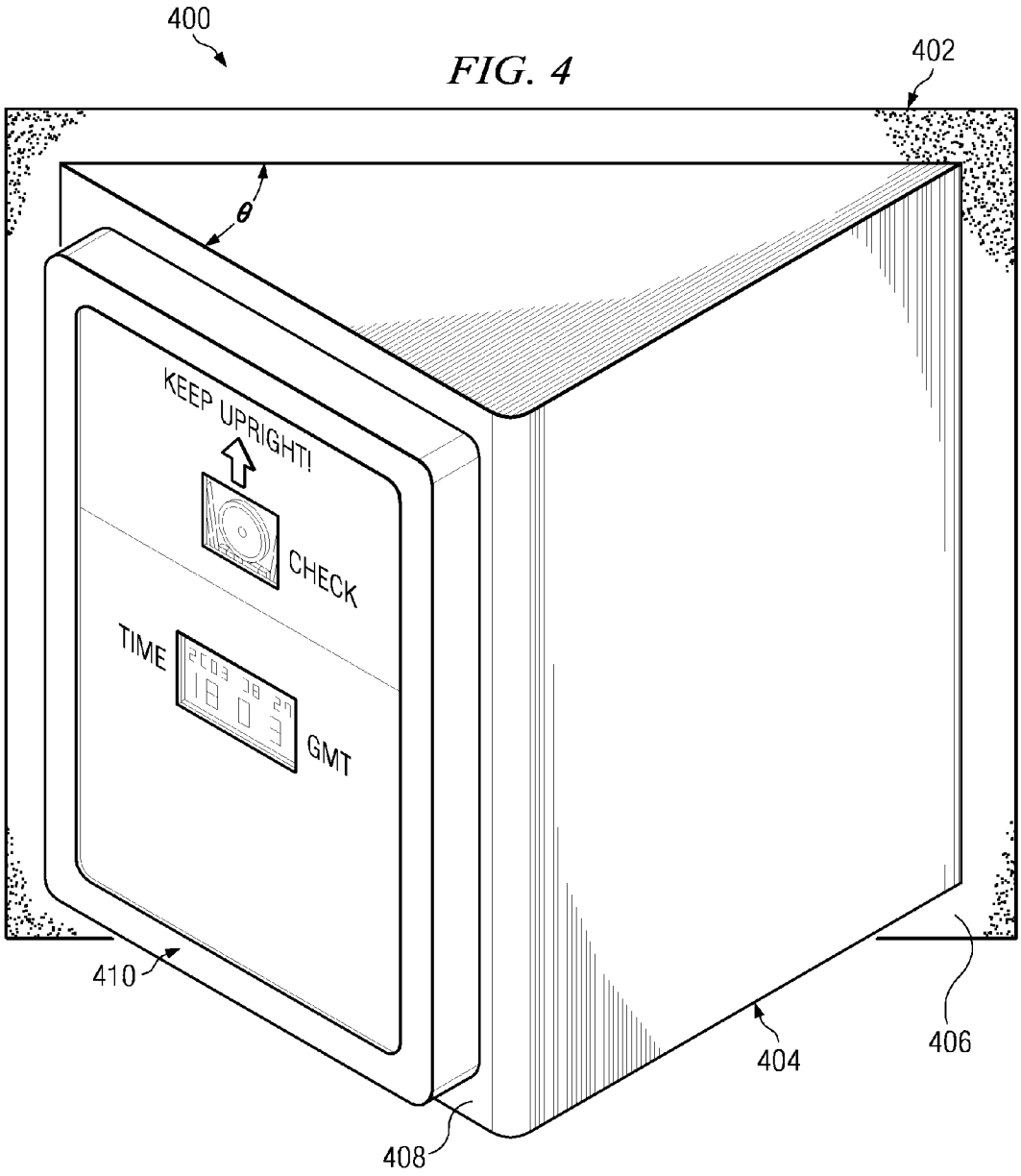
FIG. 4 schematically illustrates a bi-axial tilt monitoring apparatus according to an exemplary embodiment.

FIG. 4 schematically illustrates a bi-axial tilt monitoring apparatus according to an exemplary embodiment. The tilt monitoring apparatus is generally designated by reference number 400, and comprises a support member 402 supporting a single-axis tilt monitoring device 410.

Support member 402 comprises a molded plastic member, although support member 402 could also be formed in other ways if desired, having a triangular-shaped body portion 404 and a mounting surface portion 406. Triangular-shaped body portion 404 includes surface 408 that is inclined at an angle θ with respect to mounting surface portion 406. Tilt monitoring device 410 is affixed to surface 408, for example, by a suitable adhesive, and is, thus, also inclined at an angle θ with respect to mounting surface portion 406. Tilt monitoring device 410 may be implemented as TMC 100 in FIG. 1 or TMC 200 in FIG. 2, although it should be understood that other types of single-axis tilt monitoring devices may also be used, and it is not intended to limit bi-axial tilt monitoring apparatus 400 to an apparatus including any particular single-axis tilt monitoring device.

Figure 5:
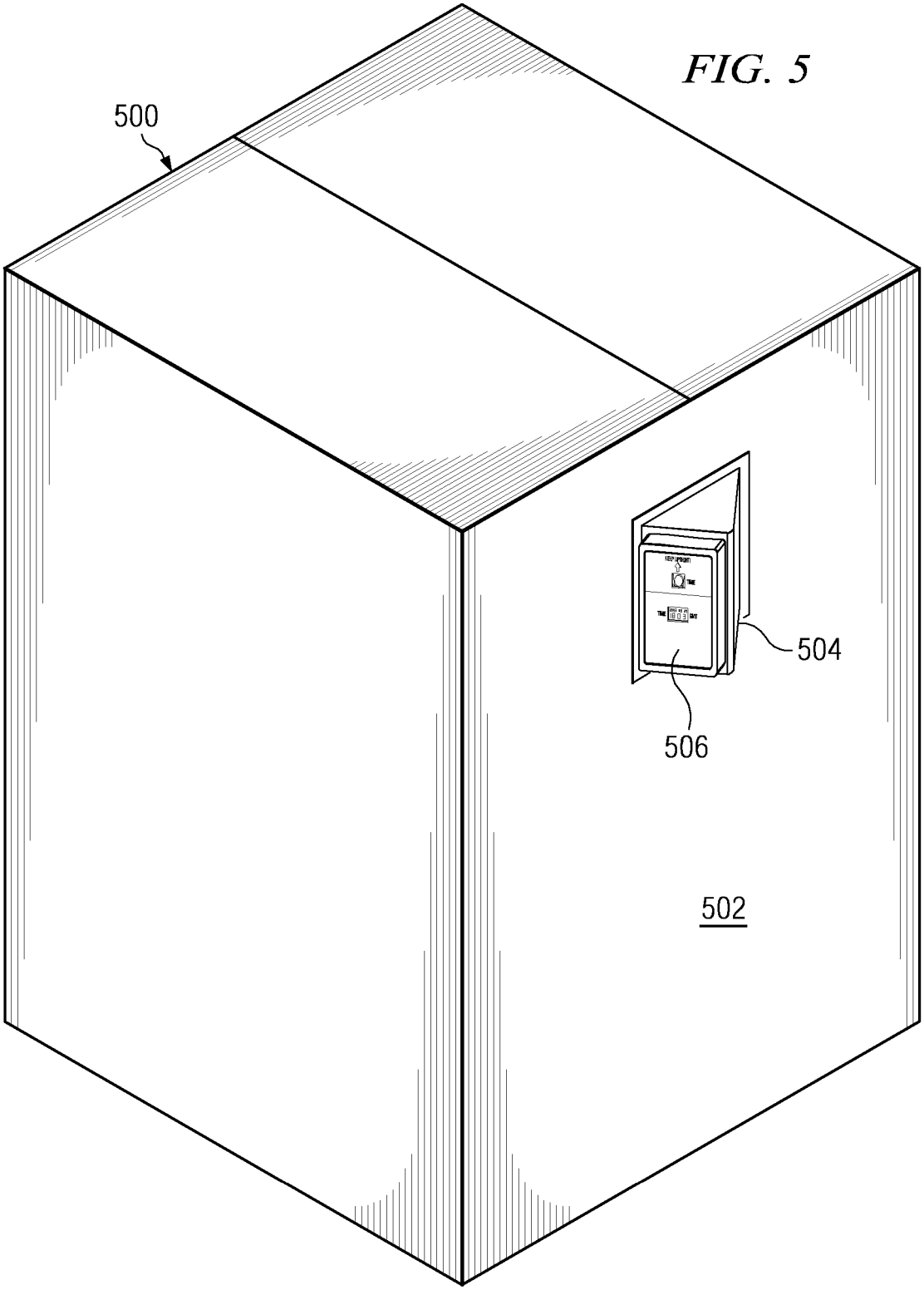
FIG. 5 is a schematic front perspective view of an article having a bi-axial tilt monitoring apparatus mounted thereto according to an exemplary embodiment.

FIG. 5 is a schematic front perspective view of an article having a bi-axial tilt monitoring apparatus mounted thereto according to an exemplary embodiment. The article is generally designated by reference number 500, and in the exemplary embodiment illustrated in FIG. 5, comprises a box, for example, a corrugated box or wooden crate, which contains one or a plurality of products to be monitored. The product to be monitored can be any product that is susceptible to being damaged when tipped. For example, as indicated previously, in the data processing field such products include large servers, storage systems, tape libraries, enterprise printers and the like. It should be understood; however, that exemplary embodiments are not limited to monitoring articles of any particular type in any particular field.

As shown in FIG. 5, bi-axial tilt monitoring apparatus 504 is mounted to vertical outer surface 502 of article 500. Bi-axial tilt monitoring apparatus 504 may be implemented as bi-axial tilt monitoring apparatus 400 in FIG. 4, and includes single-axis tilt monitoring device 506 affixed thereto. When mounted to vertical surface 502 of article 500, tilt monitoring apparatus 504 is effective in detecting excessive tipping of article 500 in any direction notwithstanding that it includes only one single-axis tilt monitoring device 506.

In particular, according to exemplary embodiments, it has been found that by mounting single-axis tilt monitoring device 506 at an appropriate acute angle Θ with respect to the plane of vertical surface 502 of article 500; bi-axial tilt monitoring functionality is achieved using only one single-axis tilt monitoring device. From testing of tilt monitoring apparatus 504 at angles of Θ equal to 35, 40, 45, 50 and 55 degrees, tilt monitoring apparatus 504 was found to be 100 percent effective in monitoring excessive tipping of an article when the article is tipped in any direction onto any of its four vertical sides. It should be understood, however, that it is not intended to limit exemplary embodiments to angles for Θ of only from about 35 degrees to about 55 degrees, as exemplary embodiments may be effective at a wider range of angles.

According to exemplary embodiments, by mounting tilt monitoring apparatus 504 to a substantially vertical surface of an article to be monitored, such as article 500, effective bi-axial tilt monitoring can be achieved using only one single-axis tilt monitoring device. As a result, tipping of an article in any direction can be detected at a lower cost resulting in a significant cost savings.

Tilt monitoring apparatus 504 can be mounted to a vertical surface of article 500 at any convenient location on the article. Apparatus 504 can also be mounted to a surface of the article in any convenient manner. For example, affixing a double-sided adhesive sheet to the bottom surface of apparatus 504 is a convenient method for mounting the apparatus to surface 502 of article 500.

Figure 6:
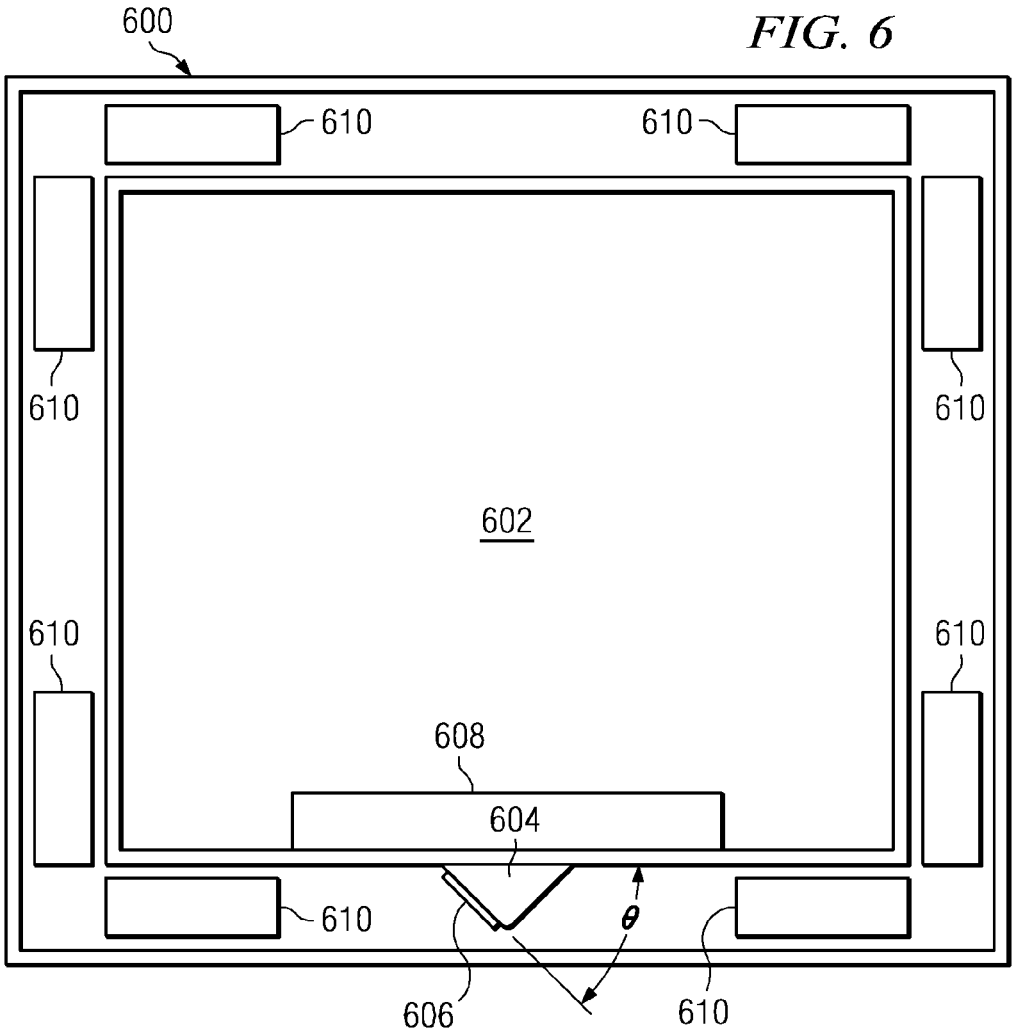
FIG. 6 schematically illustrates a top view of a packaged product having a bi-axial tilt monitoring apparatus mounted internally of outer packaging according to an exemplary embodiment.

FIG. 6 schematically illustrates a top view of a packaged product having a bi-axial tilt monitoring apparatus mounted internally of outer packaging according to an exemplary embodiment. In particular, FIG. 6 illustrates an article that comprises box 600 containing a product 602 to be monitored. In the exemplary embodiment illustrated in FIG. 6, bi-axial tilt monitoring apparatus 604 having single-axis tilt monitoring device 606 is mounted directly to an outside surface of frame 608 of product 602. Tilt monitoring apparatus 604 may be implemented as tilt monitoring apparatus 400 in FIG. 4, and by mounting the apparatus internally of box 600; it will be hidden from view and thus less likely to be tampered with.

Since apparatus 604 protrudes outwardly somewhat from product 602 to which it is mounted, it is preferably positioned in an open area between the product and the inner surface of box 600 that is created by packaging such as plastic cushions 610 which also function to protect the product within box 600.

In general, a bi-axial tilt monitoring apparatus according to exemplary embodiments allows one single-axis tilt monitoring device to effectively monitor tipping of an article regardless of the direction of tipping. Although, as indicated above, the apparatus works effectively with a built-in angle Θ equal to between about 35 degrees to about 55 degrees (ideally about 45 degrees), by using a smaller angle Θ of about 35 degrees, the support member can be made somewhat more rigid and will occupy less space which is particularly desirable when available space is tight.

Figure 7:
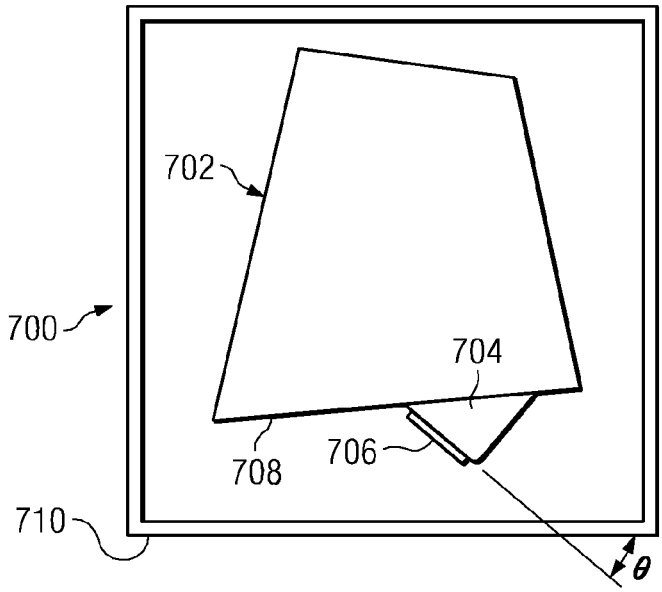
FIG. 7 schematically illustrates a top view of an irregularly-shaped packaged product having a bi-axial tilt monitoring apparatus mounted internally of outer packaging according to an exemplary embodiment.

FIG. 7 schematically illustrates a top view of an irregularly-shaped packaged product having a bi-axial tilt monitoring apparatus mounted internally of outer packaging according to an exemplary embodiment. As indicated above, a tilt monitoring apparatus according to exemplary embodiments can usually be mounted to any substantially vertical surface of an article at any convenient location on the surface. Accordingly, the tilt monitoring apparatus can usually be mounted to an irregularly-shaped article as well as to rectangular-shaped articles. This capability is illustrated in FIG. 7 which shows box 700 containing product 702. Product 702 comprises an irregularly-shaped product having four sides that are not perpendicular to one another. Bi-axial tilt monitoring apparatus 704 having single-axis tilt monitoring device 706 can be mounted to any one of the four sides, side 708 in FIG. 7, and will be effective in detecting excessive tipping of the product in any direction. As shown in FIG. 7, apparatus 704 is designed such that single-axis tilt monitoring device 706 is oriented at an appropriate acute angle θ measured with respect to the plane of vertical surface 710 of box 700.

Figure 8:
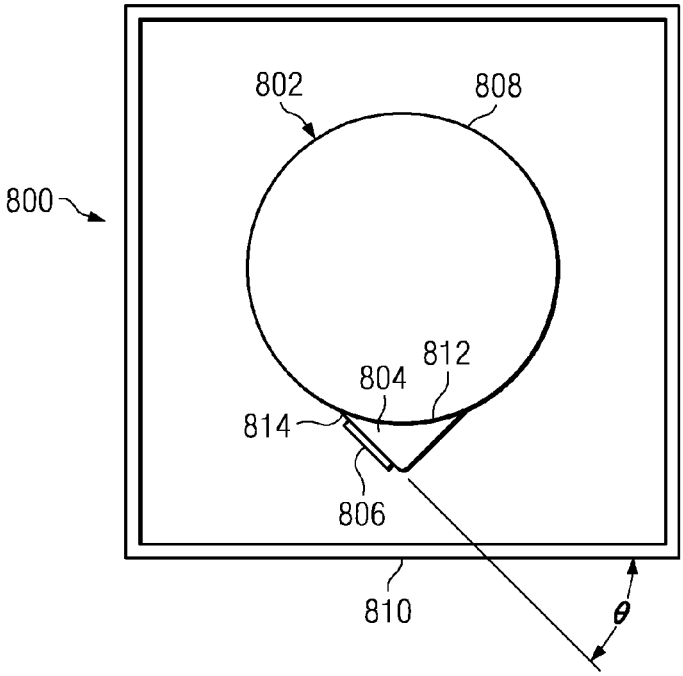
FIG. 8 schematically illustrates a top view of a cylindrical-shaped packaged product having a bi-axial tilt monitoring apparatus mounted internally of outer packaging according to an exemplary embodiment.

FIG. 8 schematically illustrates a top view of a cylindrical-shaped packaged product having a bi-axial tilt monitoring apparatus mounted internally of outer packaging according to an exemplary embodiment. As shown in FIG. 8, a bi-axial tilt monitoring apparatus according to exemplary embodiments is also effective in monitoring excessive tipping of curved articles such as cylindrical-shaped products. FIG. 8 shows box 800 containing product 802. Product 802 comprises a cylindrical-shaped product having curved vertical side 808. Bi-axial tilt monitoring apparatus 804 having single-axis tilt monitoring device 806 can be mounted to curved side 808, and is effective in detecting excessive tipping of the product in any direction.

When the tilt monitoring apparatus is to be mounted to a curved surface, mounting surface portion 812 of triangular-shaped body portion 814 is provided with the same curvature as curved side surface 808 to which it is to be mounted. As shown in FIG. 8, body portion 814 is designed such that single-axis tilt monitoring device 806 is positioned at an appropriate acute angle θ with respect to the plane of vertical surface 810 of box 800.

Figure 9:
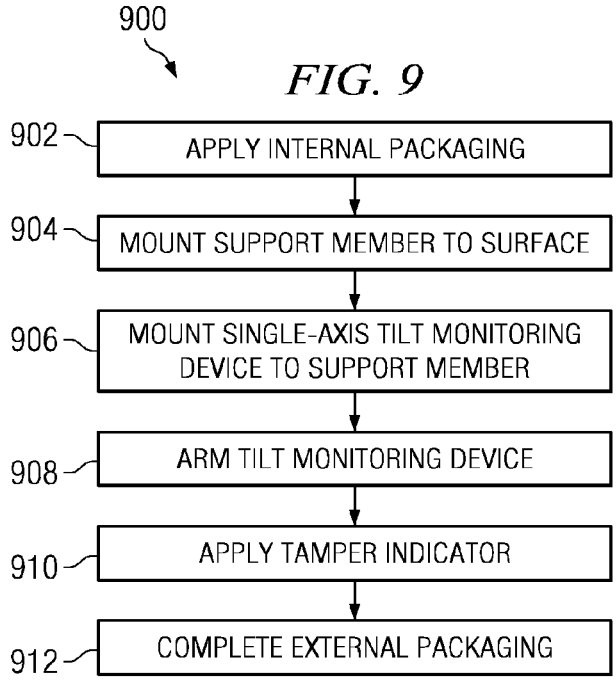
FIG. 9 is a flowchart illustrating a method for bi-axial tilt monitoring of an article using a single-axis tilt monitoring device according to an exemplary embodiment.

FIG. 9 is a flowchart illustrating a method for bi-axial tilt monitoring of an article using a single-axis tilt monitoring device according to an exemplary embodiment. The method is generally designated by reference number 900, and begins by applying appropriate internal packaging to a package for a product to be monitored to permit a bi-axial tilt monitoring apparatus according to exemplary embodiments to be positioned within the package (Step 902). A support member of the bi-axial tilt monitoring apparatus is then mounted to any substantially vertical internal surface (Step 904). The mounting may be to the product itself or to packaging around the product. The mounting may also be by direct adhesion, by adhering it to a flat piece of stiff packaging which is then adhered to the internal surface, or another appropriate manner. A single-axis tilt monitoring device, such as a TMC, is then mounted to a supporting surface of the support member (Step 906).

The bi-axial tilt monitoring apparatus is then armed by removing an arming pin from the single-axis tilt monitoring device (Step 908). Proper arming is evidenced by the conductive disk of the TMC becoming visible and the clock of the device starting. A tamper evident instruction label or the like may then be applied over the bi-axial tilt monitoring apparatus, if desired, to indicate any tampering of the apparatus that may occur (Step 910). External packaging is then completed, thereby concealing the TMC until the product is unpacked (Step 912).

Method 900 illustrated in FIG. 9 specifically describes internal mounting of a bi-axial tilt monitoring apparatus which provides advantages of avoiding protrusion of the apparatus which would result if it was externally mounted. Also, internal mounting protects the TMC from pilferage or damage during shipment. The tilt monitoring apparatus may, however, also be mounted to an external surface of an article, if desired, and it is not intended to restrict the exemplary embodiments to any particular location for mounting the apparatus to an article.

Exemplary embodiments thus provide a bi-axial tilt monitoring apparatus and a method for bi-axial tilt monitoring of an article using a single-axis tilt monitoring device. A bi-axial tilt monitoring apparatus according to exemplary embodiments includes a single-axis tilt monitoring device and a support member supporting the single-axis tilt monitoring device and mountable to an article to be monitored. The support member has a supporting surface for supporting the single-axis tilt monitoring device at an acute angle relative to a substantially vertical surface of the article to be monitored when the tilt monitoring apparatus is mounted to the article to be monitored.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A bi-axial tilt monitoring apparatus, comprising:

a single-axis tilt monitoring device; and a support member having a substantially triangular-shaped body portion and a mounting surface portion for mounting the bi-axial tilt monitoring apparatus to an article to be monitored, wherein the substantially triangular-shaped body portion comprises a surface that is inclined at a predefined angle that is relative to the mounting surface portion, wherein the single-axis tilt monitoring device is affixed to the surface, and wherein the support member is affixed to the article to be monitored at an acute angle that is between 35 degrees and 55 degrees relative to a substantially vertical surface of the article to be monitored.

2. The bi-axial tilt monitoring apparatus according to claim 1, wherein the mounting surface portion comprises a substantially flat mounting surface portion for mounting the apparatus to a substantially flat vertical surface of the article to be monitored.

3. The bi-axial tilt monitoring apparatus according to claim 1, wherein the mounting surface portion comprises a curved mounting surface portion for mounting the apparatus to a curved vertical surface of the article to be monitored.

4. The bi-axial tilt monitoring apparatus according to claim 1, wherein the article to be monitored comprises one of a product to be monitored and a container for containing a product to be monitored.

5. The bi-axial tilt monitoring apparatus according to claim 4, wherein the article to be monitored comprises a product to be monitored, and wherein the bi-axial tilt monitoring apparatus is mountable to the product internally of a container for the product.

6. A method for bi-axial tilt monitoring of an article using a single-axis tilt monitoring device, the method comprising:

mounting a support member of a bi-axial tilt monitoring apparatus to substantially vertical surface of an article to be monitored at an acute angle between 35 degrees and 55 degrees;

mounting a single-axis tilt monitoring device to a supporting surface of the support member; and arming the bi-axial tilt monitoring apparatus by removing an arming pin associated with the single-axis tilt monitoring device.

7. The method according to claim 6, wherein the article is a container containing a product to be monitored.

8. The method according to claim 6, further comprising:

applying packaging material in the container for providing a space for receiving the bi-axial tilt monitoring apparatus within the container.

9. The method according to claim 6, wherein the substantially vertical surface comprises a round surface.

* * * * *